US010454193B2

(12) United States Patent
Iwasaki et al.

(10) Patent No.: US 10,454,193 B2
(45) Date of Patent: Oct. 22, 2019

(54) CONTACT HAVING A PRESS-FIT PORTION

(71) Applicant: Tyco Electronics Japan G.K., Kanagawa (JP)

(72) Inventors: Masaaki Iwasaki, Kanagawa (JP); Yoshihiko Kodaira, Kanagawa (JP); Hiroshi Shirai, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/433,540

(22) Filed: Feb. 15, 2017

(65) Prior Publication Data

US 2017/0237188 A1 Aug. 17, 2017

(30) Foreign Application Priority Data

Feb. 17, 2016 (JP) ..... 2016-027854

(51) Int. Cl.
*H01R 12/58* (2011.01)
*H01R 4/10* (2006.01)
*H01R 13/05* (2006.01)

(52) U.S. Cl.
CPC ..... *H01R 12/585* (2013.01); *H01R 4/10* (2013.01); *H01R 13/05* (2013.01)

(58) Field of Classification Search
CPC ..... H01R 12/585; H01R 13/05; H01R 4/10; Y10S 439/943
USPC ..... 439/82, 751, 876, 943
See application file for complete search history.

(56) References Cited

U.S. PATENT DOCUMENTS 6,155,887 A * 12/2000 Cuff ..... H01R 12/585 439/751
6,685,484 B2 * 2/2004 Keyser ..... H01R 12/57 439/751
7,175,447 B2 * 2/2007 Pan ..... H01R 12/727 439/79
7,452,248 B2 * 11/2008 Seo ..... H01R 12/585 439/751
7,946,861 B2 * 5/2011 Sander ..... H01R 12/585 439/82
8,419,484 B2 * 4/2013 Kawai ..... H01R 12/585 439/733.1
2003/0114027 A1 * 6/2003 Wurster ..... H05K 3/366 439/82

(Continued)

FOREIGN PATENT DOCUMENTS

JP 200021474 A 1/2000
JP 2002-175862 A 6/2002

(Continued)

OTHER PUBLICATIONS

Abstract of JP2008204840, dated Sep. 4, 2008, 2 pages.

(Continued)

*Primary Examiner* — Tulsidas C Patel
*Assistant Examiner* — Marcus E Harcum
(74) *Attorney, Agent, or Firm* — Barley Snyder

(57) ABSTRACT

A contact is disclosed. The contact has a press-fit portion and a deformable portion. The press-fit portion is press-fit into a passageway of a circuit board. The deformable portion is disposed adjacent the press-fit portion in a direction opposite a press-fitting direction and has a shape adjacent the press-fit portion larger than the passageway. The deformable portion is plastically deformable.

15 Claims, 4 Drawing Sheets

(56) References Cited

U.S. PATENT DOCUMENTS

| | | | | |
|---|---|---|---|---|
| 2011/0009013 | A1* | 1/2011 | Tsao | H01R 12/585 439/876 |
| 2012/0302075 | A1* | 11/2012 | Muraoka | H05K 1/0251 439/78 |
| 2014/0342619 | A1* | 11/2014 | Uchida | H01R 12/585 439/751 |

FOREIGN PATENT DOCUMENTS

| | | | |
|---|---|---|---|
| JP | 2003-283093 | A | 10/2003 |
| JP | 2008192402 | A | 8/2008 |
| JP | 2008204840 | A | 9/2008 |
| JP | 2008293949 | A | 12/2008 |
| JP | 20109975 | A | 1/2010 |
| JP | 2010160898 | A | 7/2010 |
| JP | 2012-529731 | A | 11/2012 |

OTHER PUBLICATIONS

Abstract of JP2008192402, dated Aug. 21, 2008, 2 pages.
Abstract of JP2010160898, dated Jul. 22, 2010, 2 pages.
Abstract of JP2008293949, dated Dec. 4, 2008, 2 pages.
Japan Office Action, dated Jun. 10, 2019, 4 pages.
Abstract of JP 2002-175862, dated Jun. 21, 2002, 1 page.
Abstract of JP 2003-283093, dated Oct. 3, 2003, 1 page.

* cited by examiner

CONTACT HAVING A PRESS-FIT PORTION

CROSS-REFERENCE TO RELATED APPLICATION

This application claims the benefit of the filing date under 35 U.S.C. § 119(a)-(d) of Japanese Patent Application No. 2016-027854, filed on Feb. 17, 2016.

FIELD OF THE INVENTION

The present invention relates to a contact, and more particularly, to a contact which is press-fitted into a passageway of a circuit board to electrically connect with the circuit board.

BACKGROUND

Press-fit contacts which are press-fitted into passageways of a circuit board are known in the art. Japanese Patent Application No. 2010-160898A ("JP 2010-160898A") for instance discloses such a press-fit contact in FIG. 5. In FIG. 5, the press-fit contact which has been press-fitted into the passageway is electrically connected with a wiring layer embedded in the circuit board. However, a distal end portion of a press-fitted portion of the press-fit contact reaches a depth deeper than the depth of the wiring layer where the passageway is electrically conductive. When this structure is used for a high-speed signal transmission, reflection of a signal occurs at a portion of the press-fit contact which has been plugged up to a position deeper than the wiring layer, which results in disturbance of the signal. Therefore, when the passageway is longer than the wiring layer or the press-fit contact has been plugged up to a position deeper than the wiring layer, a quality of a high-speed transmission signal is lowered.

To counteract this problem, in JP 2010-160898A, the press-fit contact is created by insert-molding an electrical conductor with an insulator to the correct length. However, insert-molding results in increased manufacturing costs. A portion of the press-fit contact can also simply be shortened to address this problem. As shown in JP 2010-160898A, the portion of the contact to be press-fitted has a certain shorter length, however, this results in decreased tolerance in the positioning of the press-fit contact. When the length of the press-fit contact to be inserted into the passageway is extremely short, such as 0.4 mm or the like, the tolerance becomes severe, which results in difficulty in locating the press-fit portion in the passageway with a high degree of accuracy.

SUMMARY

An object of the invention, among others, is to provide a contact which makes it possible to accurately position a short press-fit portion of the contact. The disclosed contact has a press-fit portion and a deformable portion. The press-fit portion is press-fit into a passageway of a circuit board. The deformable portion is disposed adjacent the press-fit portion in a direction opposite a press-fitting direction and has a shape adjacent the press-fit portion larger than the passageway. The deformable portion is plastically deformable.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
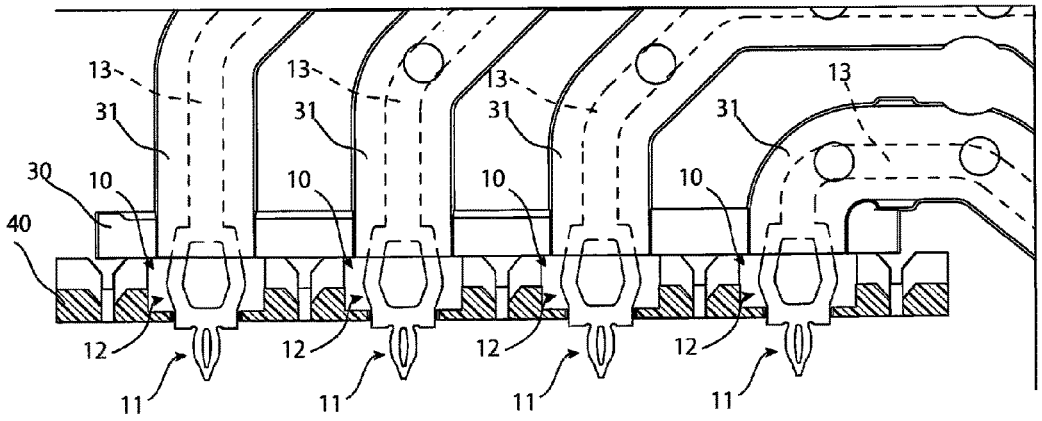
FIG. 1 is a top view of a contact according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A contact 10 according to the invention is shown in FIG. 1. In FIG. 1, four contacts 10 are disposed side by side. These contacts 10 are supported by a housing 30 made of resin. Each contact 10 has a press-fit portion 11 and a deformable portion 12. The press-fit portion 11 is press-fitted into a passageway 21 of a circuit board 20, as shown in FIG. 2, and the contact 10 electrically connects with the circuit board 20. The circuit board 20 is a circuit board where wiring layers constituting a multilayer having, for example, twenty layers or the like have been embedded within the thickness of the circuit board 20. The press-fit portion 11 forms an electric connection with the shallowest wiring layer of the wiring layers constituting a multilayer embedded in the circuit board 20.

An alignment plate 40 is movable in a vertical direction in FIG. 1 relative to the housing 30. In FIG. 1, the alignment plate 40 is in an upper position. When the alignment plate 40 is in a lower position, the contacts 10 are not connected to the circuit board 20 and the alignment plate 40 protects the press-fit portions 11 of the contacts 10. The alignment plate 40 also serves to locate the contacts 10 and is pushed by the circuit board 20 upward when the press-fit portions 11 are press-fitted into the passageways 21 of the circuit board 20.

A wiring portion 13, as shown in FIG. 1, extends and curves laterally from each contact 10. A distal end portion extending from each wiring portion 13 is connected to a mating circuit board. Each wiring portion 13 extending from each contact 10 is surrounded by resin 31. The press-fit portion 11 and the deformable portion 12 constituting each contact 10 along with each wiring portion 13 extending from each contact 10 are integrally formed and are manufactured by stamping a single flat plate of conductive material. A high-speed signal transmission is performed between the mating circuit board and the circuit board 20 shown in FIGS. 2A and 2B through the wiring portion 13.

Figures 2A, 2B:
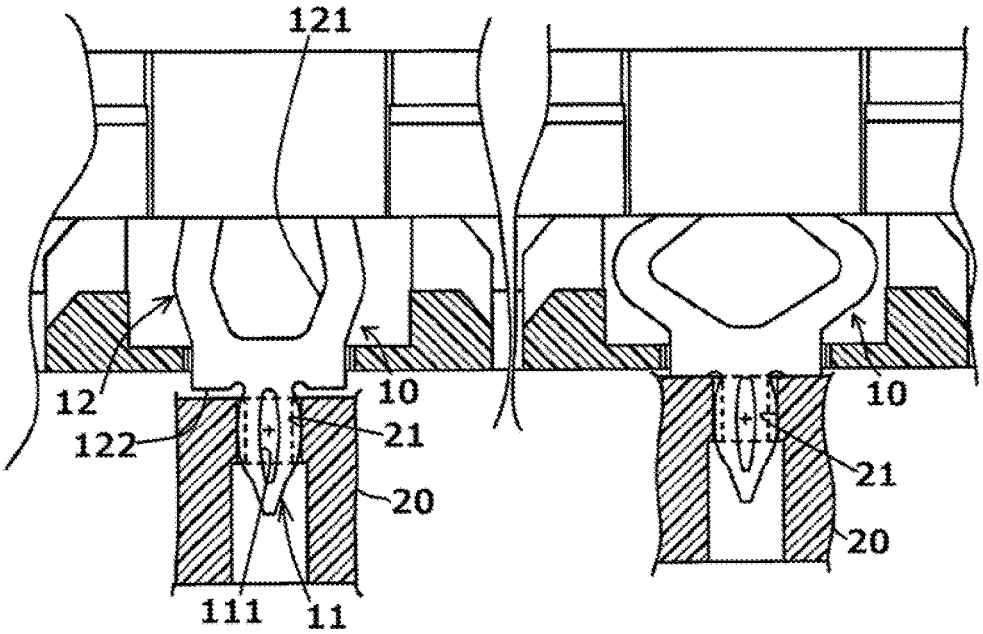
FIG. 2A is a top view of the contact of FIG. 1 during press-fitting into a circuit board.
FIG. 2B is a top view of the contact of FIG. 1 after press-fitting into the circuit board.

The contact 10 is shown during press-fitting in FIG. 2A and after press-fitting in FIG. 2B. The press-fit portion 11 is press-fitted into the passageway 21 of the circuit board 20. The press-fit portion 11 has a press-fit opening 111 at a central portion thereof and plastically deforms about the press-fit opening 111 during press-fitting.

The deformable portion 12 is located adjacent the press-fit portion 11 in a direction opposite a direction of press-fitting the press-fit portion 11 into the passageway 21. The deformable portion 12 also has a deformable opening 121 at a central portion thereof. Further, a stopper 122 extending orthogonally to the press-fit portion 11 to form a step is disposed at a lower end of the deformable portion 12.

The stopper 122 abuts on a portion of an upper face of the circuit board 20 located around the passageway 21 when the press-fit portion 11 has been press-fitted into the passageway 21 up to a predetermined depth. The stopper 122 abuts on the circuit board 20 so that further insertion of the press-fit portion 11 into the passageway 21 is restricted. Thereafter, the deformable portion 12 receives a further load to plastically deform in a shape shown in FIG. 2B. The deformable portion 12 has such a strength that it plastically deforms only when it has received a second load greater than a first load required for the press-fit portion 11 to be press-fitted into the passageway 21.

A size error of the deformable portion 12, for example, a fixing position error to the housing 30 above the deformable portion 12 or a load error at press-fitting, is absorbed by deformation of the deformable portion 12. Therefore, only a size of the press-fit portion 11 below the stopper 122 is required to be formed with a high degree of accuracy. In the contact 10, even if the press-fit portion 11 has an extremely short size, the press-fit portion 11 is press-fitted up to a depth located with a high degree of accuracy with respect to the circuit board 20.

A method for press-fitting the press-fit portion 11 in a state before the deformable portion 12 is deformed has been explained, but the deformable portion 12 may be caused to deform before press-fitting of the press-fit portion 11. That is, a dummy circuit board having a hole with a diameter slightly larger than the passageway 21 of the circuit board 20 is prepared, and the deformable portion 12 is deformed by pushing the stopper 122 of the deformable portion 12 against the dummy circuit board in advance. Thereby, a size error of the deformable portion 12 is absorbed in advance. Thereafter, the press-fit portion 11 is press-fitted into the passageway 21 of the circuit board 20. A load to be applied is sufficient for press-fitting the press-fit portion 11 without deforming the deformable portion 12. Even when this method is adopted, the press-fit portion 12 can be press-fitted into the passageway 21 of the circuit board 20 with a high degree of accuracy.

Figure 3A:
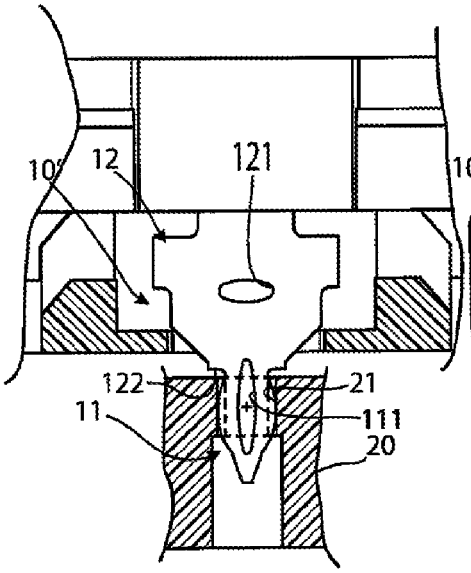
FIG. 3A is a top view of another contact according to the invention during press-fitting into a circuit board.
Figure 3B:
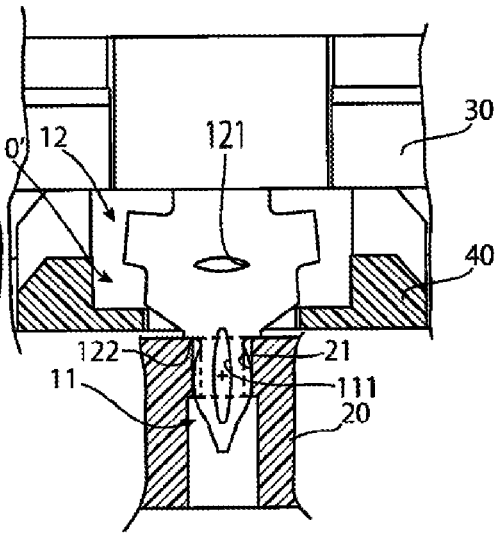
FIG. 3B is a top view of the contact of FIG. 3A after press-fitting into the circuit board.

A contact 10' according to another embodiment of the invention is shown in FIGS. 3A and 3B. Like reference numerals indicate like elements, and only differences will be explained with respect to the embodiment shown in FIGS. 1 and 2.

The contact 10' of the second example shown in FIGS. 3A and 3B is different in shape from the deformable portion 12 of the contact 10. That is, the stopper 122 of the deformable portion 12 of the contact 10' has a width narrower than that of the stopper 122 of the deformable portion 12 of the contact 10. The deformable opening 121 of the contact 10' is also smaller than the deformable opening 121 of the contact 10.

The stopper 122 with the narrower width avoids damaging another wiring pattern on a surface of the circuit board 20 disposed in the vicinity of the passageway 21. Further, the shape or the size of the deformable opening 121 of the contact 10' is designed such that the deformable portion 12 deforms with a proper load according to the thickness, size, and material of the flat-plate contact 10'. The deformable portion 12 of the contact 10' plastically deforms in a shape shown in FIG. 3B.

Figures 4A, 4B:
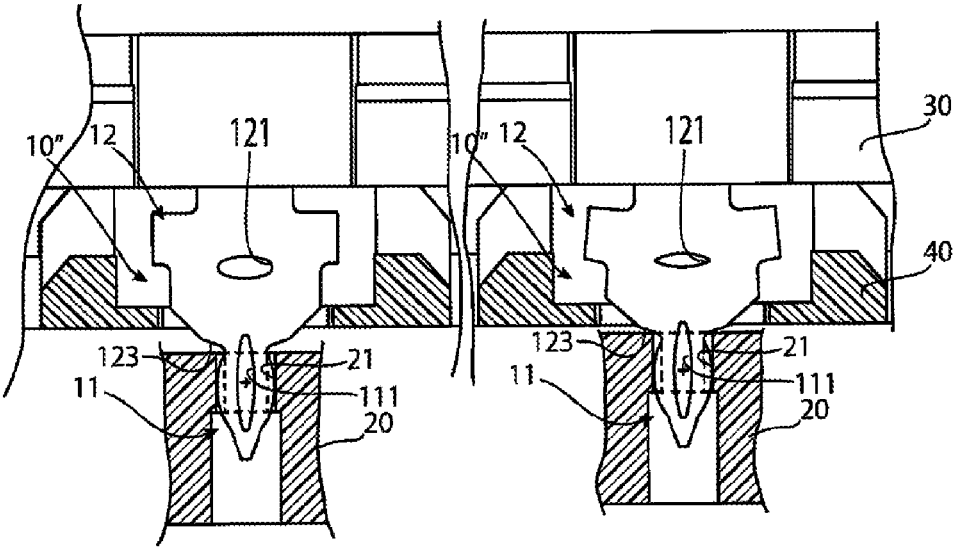
FIG. 4A is a top view of another contact according to the invention during press-fitting into a circuit board.
FIG. 4B is a top view of the contact of FIG. 4A after press-fitting into the circuit board.

A contact 10" according to another embodiment of the invention is shown in FIGS. 4A and 4B. Like reference numerals indicate like elements, and only differences will be explained with respect to the embodiments shown in FIGS. 1-4.

The contact 10" has a shoulder 123 formed on a slope extending away from the press-fit portion 11. The shoulder 123 is approximately the same size as the stopper 122 of the contact 10'. In the contact 10', when the contact 10' is thin and the size of the stopper 122 is small, the stopper 122 may enter the passageway 21 while shaving a wall face of the passageway 21. The contact 10" has the shoulder portion 123 formed on the slope instead of the stopper 122. The shoulder portion 123 blocks entrance of the deformable portion 12 into the passageway 21. By forming the shoulder portion 123, the deformable portion 12 can be plastically deformed without causing the deformable portion 12 to enter the passageway 21 even when another wiring pattern on a surface of the circuit board 20 is disposed close to the passageway 21. Advantageously, in the contact 10, 10', 10" according to the invention, it is possible to position the short press-fit portion 11 with a high degree of accuracy. A tolerance of the contact 10, 10', 10" is absorbed by plastic deformation of the deformable portion 12, and therefore, only the press-fit portion 11 must be manufactured with a high degree of accuracy, lessening manufacturing costs of the contact 10, 10', 10".

What is claimed is:

1. A contact assembly, comprising:

a housing;

a contact supported by the housing and having:

(a) a press-fit portion adapted for a press-fit into a passageway of a circuit board, and (b) a deformed portion:

(1) adjacent the press-fit portion in a direction opposite a press-fitting direction, and (2) having a shape adjacent the press-fit portion larger than:

(i) the passageway into which the press-fit portion is press-fitted, and (ii) the press-fit portion; and (3) having such a strength that the deformed portion of each contact plastically deforms in a plane of the contact only when the deformed portion receives a second load greater than a first load required for the press-fit portion to be press-fitted into the passageway of the circuit board, and a wiring portion fixed to the housing and connected to the contact.

2. The contact assembly of claim 1, wherein the press-fit portion has a press-fit opening at a central portion thereof.

3. The contact assembly of claim 1, wherein the deformed portion has a shoulder formed on a slope extending away from the press-fit portion of the contact.

4. The contact assembly of claim 1, wherein the press-fit portion and the deformed portion are integrally formed.

5. The contact assembly of claim 4, wherein the press-fit portion and the deformed portion are formed of a single flat plate.

6. The contact assembly of claim 1, wherein the press-fit portion of the contact, the deformed portion of the contact, and the wiring portion of the contact are integrally formed of a single flat plate.

7. The contact assembly of claim 6, wherein the wiring portion is surrounded by a resin.

8. The contact assembly of claim 1, wherein the deformed portion has a stopper surface disposed adjacent the press-fit portion of the contact.

9. The contact assembly of claim 8, wherein the stopper surface is adapted to abut a surface of the circuit board.

10. The contact assembly of claim 9, wherein the deformed portion has a deformed opening at a central portion thereof.

11. A contact assembly, comprising:

a housing;

a plurality of contacts supported by the housing with each contact having:

(a) a press-fit portion adapted for a press-fit into a passageway of a circuit board, and (b) a deformed portion:

(1) adjacent the press-fit portion in a direction opposite a press-fitting direction, and (2) having a shape adjacent the press-fit portion larger than:

(i) the passageway into which the press-fit portion is press-fitted, and (ii) the press-fit portion; and (3) having such a strength that the deformed portion of each contact plastically deforms in a plane of the contact only when the deformed portion receives a second load greater than a first load required for the press-fit portion to be press-fitted into the passageway of the circuit board, and a wiring portion fixed to the housing and connected to the plurality of contacts.

12. The contact assembly of claim 11, further comprising an alignment plate movable in a direction relative to the housing between an upper position and a lower position.

13. The contact assembly of claim 12, wherein, in the upper position of the alignment plate, the press-fit portions of the contacts are exposed.

14. The contact assembly of claim 13, wherein the alignment plate is movable between the lower position and the upper position by the circuit board when the press-fit portions are press-fitted into the circuit board.

15. A contact assembly, comprising:

a housing; and a plurality of contacts supported by the housing with each contact having a press-fit portion press-fit into a passageway of a circuit board and a deformed portion adjacent the press-fit portion in a direction opposite a press-fitting direction, the deformed portion of each contact having a shape adjacent the press-fit portion larger than the passageway into which the press-fit portion is press-fitted and having such a strength that the deformed portion plastically deforms in a plane of the contact only when the deformed portion receives a second load greater than a first load required for the press-fit portion to be press-fitted into the passageway of the circuit board.

* * * * *